US010150541B2

(12) United States Patent
Dykstra et al.

(10) Patent No.: US 10,150,541 B2
(45) Date of Patent: Dec. 11, 2018

(54) OFFSHORE DRILLING PLATFORM VIBRATION COMPENSATION USING AN ITERATIVE LEARNING METHOD

(71) Applicant: Halliburton Energy Services, Inc., Houston, TX (US)

(72) Inventors: Jason D. Dykstra, Spring, TX (US); Xingyong Song, Houston, TX (US); Yiming Zhao, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/524,247

(22) PCT Filed: Jan. 15, 2016

(86) PCT No.: PCT/US2016/013523
§ 371 (c)(1),
(2) Date: May 3, 2017

(87) PCT Pub. No.: WO2017/123237
PCT Pub. Date: Jul. 20, 2017

(65) Prior Publication Data
US 2018/0072391 A1 Mar. 15, 2018

(51) Int. Cl.
*B63B 39/00* (2006.01)
*E21B 15/02* (2006.01)
(Continued)

(52) U.S. Cl.
CPC ..... *B63B 39/005* (2013.01); *B63B 35/4413* (2013.01); *E21B 15/02* (2013.01);
(Continued)

(58) Field of Classification Search
None
See application file for complete search history.

(56) References Cited

U.S. PATENT DOCUMENTS 4,382,361 A 5/1983 Blanchet
5,209,302 A 5/1993 Robichaux et al.
(Continued)

FOREIGN PATENT DOCUMENTS

WO 2007145503 A1 12/2007

OTHER PUBLICATIONS

Neupert; A Heave Comensation Approach for Offshore Cranes; Jun. 2008; American Control Conference, p. 538-543; https://ieeexplore.ieee.org/abstract/document/4586547/ (Year: 2008).*
(Continued)

*Primary Examiner* — David P. Merlino
(74) *Attorney, Agent, or Firm* — Gilliam IP PLLC

(57) ABSTRACT

A method includes calculating a frequency and a phase of a vibration of a floating vessel, generating a control signal based on the vibration frequency and the vibration phase, operating a motion compensation system of the floating vessel during an $i^{th}$ control cycle using the control signal to mitigate the vibration of the floating vessel, calculating a first vibration amplitude based on the control signal, updating one or more parameters including a magnitude of the control signal, a decay rate of the vibration, the vibration phase, and the vibration frequency using the first vibration amplitude, updating the control signal based on the one or more updated parameters, and operating the motion compensation system based on the updated control signal during an $(i+1)^{th}$ control cycle.

12 Claims, 5 Drawing Sheets

(51) Int. Cl.

| | |
|---|---|
| ***E21B 19/09*** | (2006.01) |
| ***B63B 35/44*** | (2006.01) |
| *B63B 35/03* | (2006.01) |
| *E21B 41/00* | (2006.01) |

(52) U.S. Cl.
CPC ..... *E21B 19/09* (2013.01); *B63B 35/03* (2013.01); *B63B 2035/442* (2013.01); *E21B 2041/0028* (2013.01)

(56) References Cited

U.S. PATENT DOCUMENTS

| | | | | |
|---|---|---|---|---|
| 5,233,540 | A * | 8/1993 | Andersson | G10K 11/178 700/280 |
| 6,953,308 | B1 | 10/2005 | Horton | |
| 8,443,896 | B2 | 5/2013 | Howard et al. | |
| 2010/0057279 | A1 | 3/2010 | Kyllingstad | |
| 2010/0230370 | A1* | 9/2010 | Schneider | B63B 27/10 212/276 |
| 2011/0146556 | A1 | 6/2011 | Yuan | |
| 2016/0050490 | A1* | 2/2016 | Bruckman | G05D 19/02 381/97 |

OTHER PUBLICATIONS

International Search Report and Written Opinion for PCT/US2016/013523 dated Oct. 14, 2016.

* cited by examiner

OFFSHORE DRILLING PLATFORM VIBRATION COMPENSATION USING AN ITERATIVE LEARNING METHOD

BACKGROUND

The operations of many floating vessels in the oil and gas industry, such as semi-submersible drilling rigs, drill ships, and pipe-laying ships, are impeded by sea swell. Sea waves impart an up-and-down motion to a vessel, referred to as "heave" or "vibration," with the period of the waves ranging anywhere from a few seconds up to about 30 seconds or so and the amplitude of the waves ranges from a few centimeters or inches up to about 15 meters (about 50 feet) or more.

This up-and-down motion imparted to the vessel is then correspondingly imparted to any loads or structures attached to the vessel. This heave motion of the loads or structures extending from the vessel is often highly undesirable, and even dangerous, to equipment and rig personnel. For example, when attempting to drill a wellbore in the seabed, the heave motion can cause a corresponding reciprocating motion of the drill string. Because one end of the drill string is coupled to the platform while the opposite end is coupled to the drill bit in the wellbore, the up-and-down movement of the drill string can vary the weight on bit (WOB) and this can adversely affect the drilling operation.

Heave compensation is directed to reducing the effect of this up-and-down motion on a load (e.g., the drilling string) attached to the vessel. Heave compensation systems may be used that typically involve measuring the movement of the vessel using a measuring device, such as a motion reference unit ("MRU"), and using a signal from the MRU that represents the motion of the vessel to compensate for the motion. The signal is used to control a motion compensation system that substantially cancels out the heave or vibration of the floating vessel due to the ocean waves. The principle behind heave compensation is to control the motion compensation system in a manner equal to but opposite the heave motion of the vessel to cancel out heave so the desired motion of the load is achieved irrespective of the motion of the vessel.

Presently, the signal to control conventional motion compensation systems is provided using traditional proportional-integral-derivative (PID) controllers. These PID controllers generate the signal by reacting to an error value between a measured process variable at a given instance and a desired setpoint. As a result, the PID controllers constantly react to the error and wellbore operations are not performed in a steady and controllable manner.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to vibration compensation of floating vessels and, more particularly, to improving vibration compensation of offshore drilling platforms using an iterative learning method.

Embodiments described herein provide an iterative learning control algorithm to optimize and otherwise mitigate the effects of the vibration of the offshore drilling platforms and thereby on the drilling process due to ocean waves interacting with offshore drilling platforms. The method can reliably mitigate drill string vibration so that the drilling process can be performed in a steady and controlled manner over an increased range of ocean wave sizes and frequencies. This vibration compensation method utilizes the repetitive/cyclic nature of the ocean waves to generate an active damping control signal using the iterative learning control algorithm. Once the active damping control signal has been determined from the wave effects on the offshore platform, it can be used to compensate the motion of the platform. Although embodiments disclosed are described with respect to offshore oil and gas drilling and production platforms or rigs, embodiments described herein are equally applicable to providing vibration compensation to other types of floating vessels, without departing from the scope of the disclosure.

Figure 1:
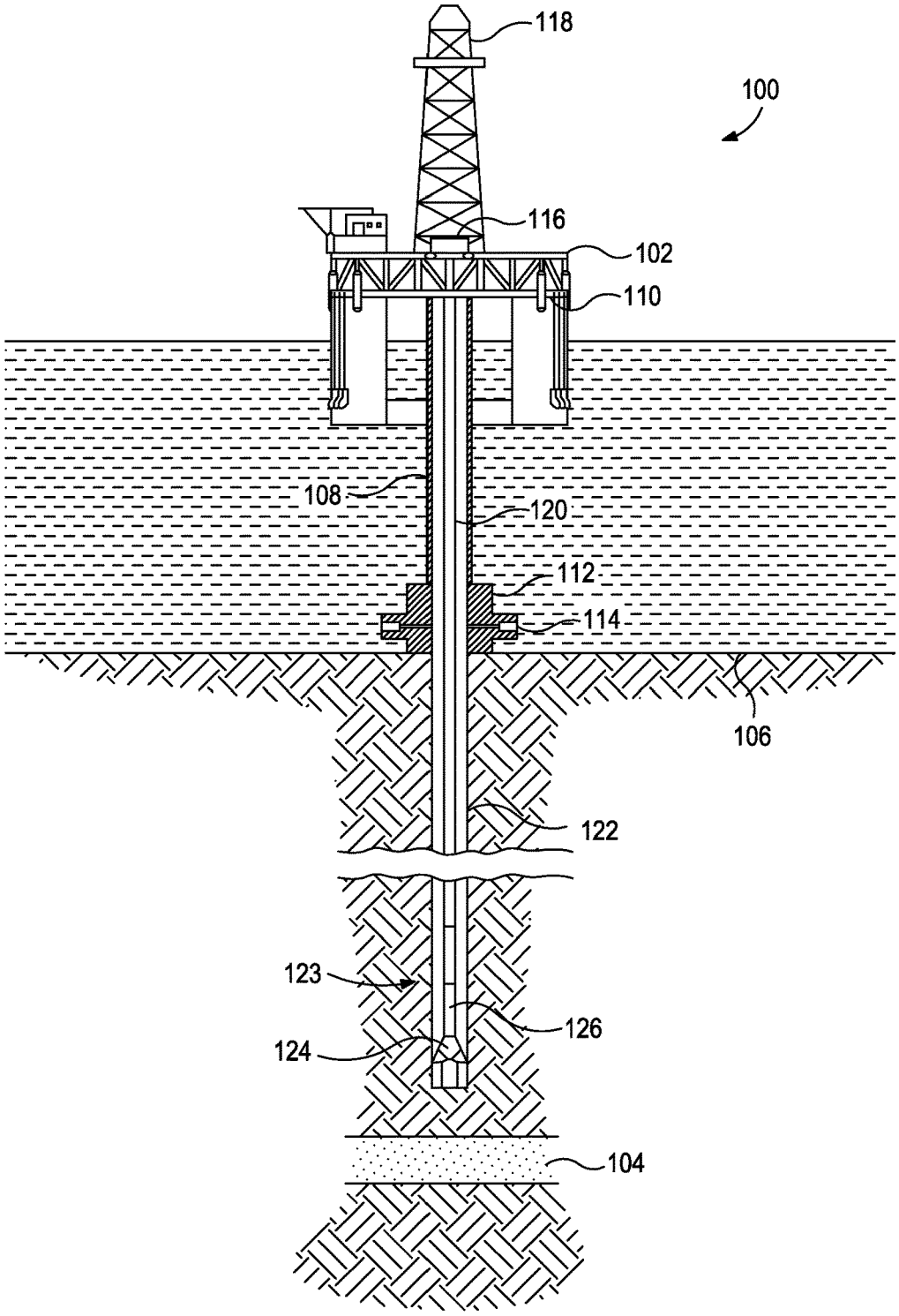
FIG. 1 is a well system that may employ vibration compensation according to the principles of the present disclosure.

FIG. 1 depicts an exemplary well system 100 that may employ the principles of the present disclosure. More particularly, the well system 100 may include a floating vessel 102 centered over a subterranean hydrocarbon bearing formation 104 located below a sea floor 106. As illustrated, the floating vessel 102 is depicted as an offshore, semi-submersible oil and gas drilling platform, but could alternatively comprise any other type of floating vessel such as, but not limited to, a drill ship, a pipe-laying ship, a tension-leg platforms (TLPs), a "spar" platform, a production platform, a cruise liner, an aircraft carrier, a tug boat, and the like. A subsea conduit or riser 108 extends from a deck 110 of the floating vessel 102 to a wellhead installation 112 that may include one or more blowout preventers 114. The floating vessel 102 has a hoisting apparatus 116 and a derrick 118 for raising and lowering tubular lengths of drill pipe, such as a drill string 120.

A wellbore 122 extends through the various earth strata toward the subterranean hydrocarbon bearing formation 104 and the drill string 120 is extended within the wellbore 122. At its distal end, the drill string 120 includes a bottom hole assembly (BHA) 123 that includes a drill bit 124 and a downhole drilling motor 126, also referred to as a positive displacement motor ("PDM") or "mud motor."

Circulating fluid is pumped through an interior fluid passageway of the drill string 120 to the downhole drilling motor 126, which converts the hydraulic energy of the circulating fluid to mechanical energy in the form of a rotating rotor. The rotor is coupled to the drill bit 124 via a transmission unit and output driveshaft to cause rotation of the drill bit 124, and thereby allows the wellbore 122 to be extended.

Even though FIG. 1 depicts a vertical wellbore 122 being drilled, it should be understood by those skilled in the art that the downhole drilling motor 126 is equally well suited for use in horizontal or deviated wellbores. It will also be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Figure 2:
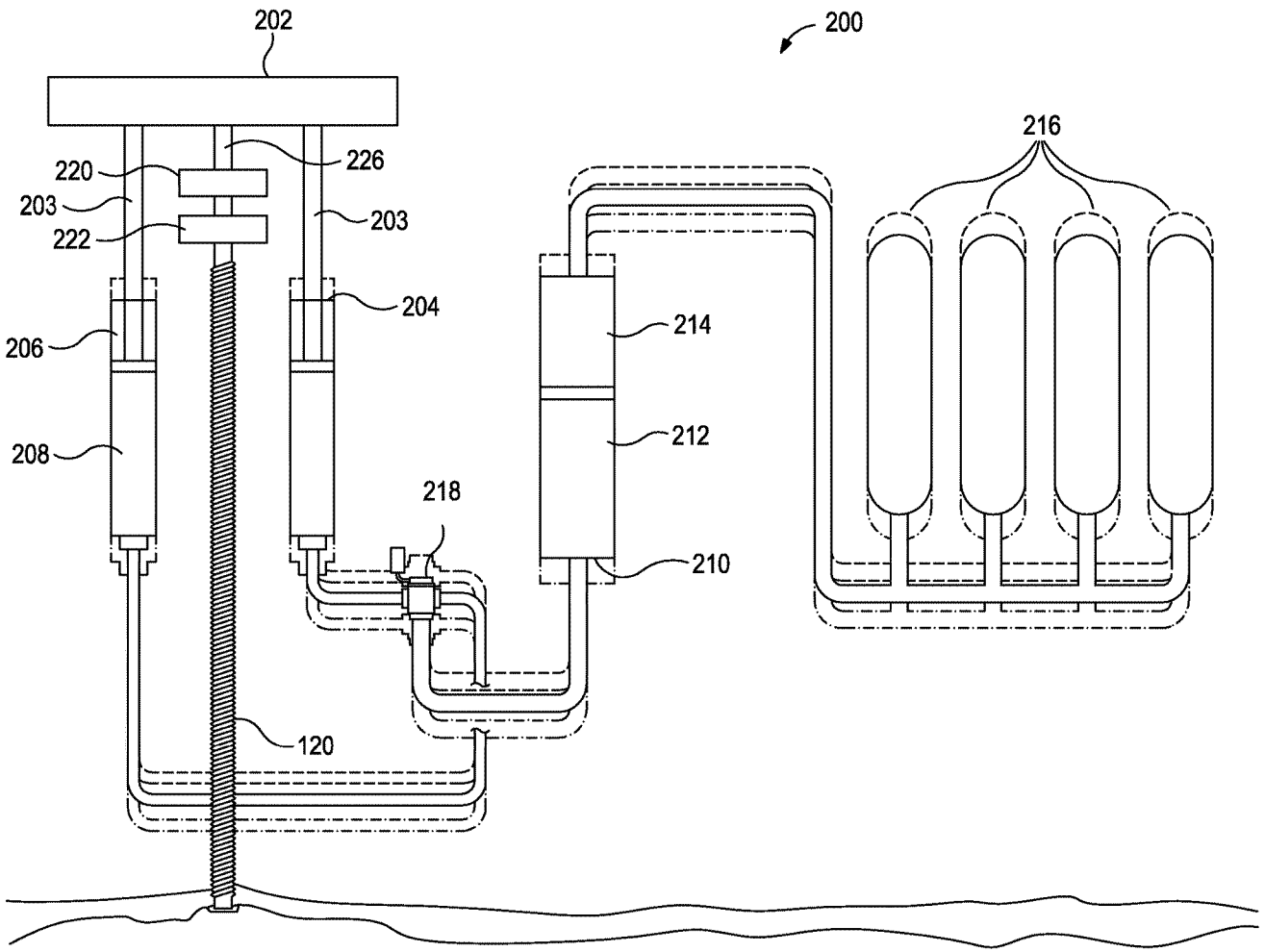
FIG. 2 illustrates a schematic view of a motion compensation system controlled using the exemplary vibration compensation method disclosed herein.

FIG. 2 illustrates a schematic view of a motion compensation system 200 controlled using the exemplary vibration compensation method disclosed herein. As illustrated, portions of the motion compensation system 200 are illustrated in phantom (dashed lines) to indicate an up-and-down motion of the motion compensation system 200. It should be noted that the motion compensation system 200 described herein is merely an example of heave compensation systems that are used onboard floating vessels to cancel out the vibrations due to ocean waves. Accordingly, the vibration compensation method according to the embodiments disclosed herein is not restricted to the motion compensation system 200, but is equally applicable to other heave compensation systems, without departing from the scope of the disclosure.

The motion compensation system 200 may be arranged on the floating vessel 102 of the well system 100 in FIG. 1 and may include a crown block 202 with one or more compensator cylinders 204 coupled to the crown block 202 via pistons 203 extending out of the one or more compensator cylinders 204. The motion compensation system 200 may further include an accumulator 210 fluidly coupled to the one or more compensator cylinders 204 with one or more gas chambers 216. As used herein, "fluidly coupled" refers to a fluidic connection between two or more component parts such that fluid (e.g., liquid or gas) may flow (communicate) between the elements.

The crown block 202 may be coupled to a traveling block 220 via a cable 226 extending between the crown block 202 and the traveling block 220. The cable 226 may be coupled between the crown block 202 and the traveling block 220, such as in a block and tackle arrangement. A drive 222, such as a top drive, may be connected to the traveling block 220 and may be used to turn the drill string 120 (FIG. 1) and/or to at least partially assist and move the traveling block 220 within the motion compensation system 200. The drill string 120 may be connected to the traveling block 220, such as through the drive 222 and/or may include one or more other connection devices coupled therebetween. Although, not illustrated in FIG. 2, the bottom hole assembly 123 (FIG. 1) including the drill bit 124 and the downhole drilling motor 126 may be disposed at the distal end of the drill string 120.

The pistons 203 may separate each compensator cylinder 204 into a first side 206 and a second side 208 that is filled with fluid (e.g., liquid). As the crown block 202 moves, this movement may exert pressure on the second side 208 of the compensator cylinders 204 such that fluid may move between the compensator cylinders 204 and the accumulator 210 fluidly coupled thereto. In particular, fluid may pass between the second side 208 of the compensator cylinders 204 and a first side 212 of the accumulator 210. A control unit 218 such as a motion compensator valve (MCV) may selectively control fluid flow between the compensator cylinders 204 and the accumulator 210. Generally, when the MCV 218 is open, fluid flows from the compensator cylinders 204 into the accumulator 210 when the floating vessel 102 heaves upward, and flows in the opposite direction when the floating vessel 102 descends into an ocean wave trough.

As fluid passes into and out of the first side 212 of the accumulator 210 pressure is exerted on a second side 214 of the accumulator 210. Fluid, such as a gas (e.g., air), may be included in the second side 214 of the accumulator 210 and the gas may pass between the second side 214 of the accumulator 210 and the gas chambers 216. As such, in one or more embodiments, liquid may be used as fluid in one portion of the motion compensation system 200, such as between the second side 208 of the compensator cylinders 204 and the first side 212 of the accumulator 210, and gas may be used as fluid in another portion of the motion compensation system 200, such as between the second side 214 of the accumulator 210 and the gas chambers 216. This arrangement may enable gas within the motion compensation system 200 to provide a low frequency dampening effect as the crown block 202 and the drill string 120 coupled thereto moves.

Because the ocean wave effect on the floating vessel 102 typically has a cyclic response including crests (heaves) and troughs, a control signal for controlling the motion compensation system 200 may also have a similar form. Generally, a wave signal may be expressed as $$w(t)=\Sigma_{i=1}^{N}A_i f(\omega_i t), \qquad \text{Equation 1}$$

where ω is the frequency, $A_i$ is the amplitude, $f(\omega_i t)$ is the wave function, and N is the total number of wave functions. For example, considering a sinusoidal wave, the wave function may be expressed as $f(\omega t)=\sin \omega t$. From Fourier series theory, if the wave function $f(\omega t)$ is chosen to be a sinusoidal function, and N is assumed infinitely large, then virtually all curves can be represented by the wave signal w(t) above. However, with a well-defined wave function $f(\omega t)$, the total number of functions N can be greatly reduced. Assuming a sine wave, the general form of the wave signal w(t) above can be re-written as $$f=A\sin(\omega t+\varphi)e^{-\tau t} \qquad \text{Equation 2}$$

where A is the amplitude, ω is the frequency of the sinusoid, φ is the phase of the sinusoid, τ is the decay rate of the exponential function, and t is the time elapsed for one control cycle. It should be noted that the general form of the wave signal $f$ expressed above is merely an example and that the wave signal $f$ could alternatively be represented in other forms as well, without departing from the scope of the disclosure.

Figure 3:
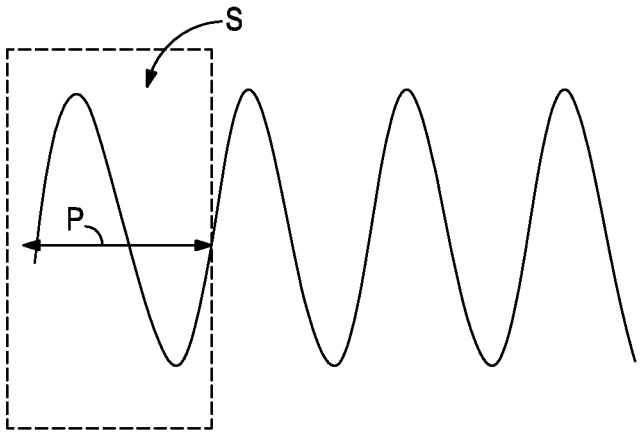
FIG. 3 illustrates the sinusoidal pattern exhibited by the ocean waves.
Figure 4:
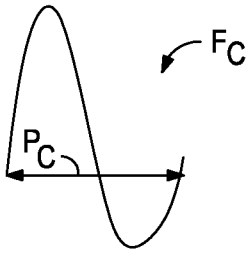
FIG. 4 illustrates a control signal generated using the exemplary vibration compensation method disclosed herein.

As mentioned above, the control signal u(t) that is provided to the motion compensation system 200 may have a waveform similar to the cyclic response of the ocean waves. For instance, referring to FIG. 3, the ocean waves are assumed to exhibit a sinusoidal type pattern S having a period P, and the control signal u(t) shown in FIG. 4 may thus be generated such that it also has a sinusoidal shape and a time period $P_C$ approximately equal to the period P of the ocean waves. Stated otherwise, the control signal u(t) may be generated such that the waveform thereof follows the cyclic nature of ocean waves.

The control signal u(t) may be used to actuate one or more control units of a heave compensation system. For instance, referring again to FIG. 2, the control signal u(t) may be used to actuate (e.g., open or close) the MCV 218 of the motion compensation system 200 to mitigate the up-and-down motion of the floating vessel 102 due to the ocean waves. Either the control signal u(t) may directly control the opening/closing of the MCV 218 or the control signal u(t) may be provided to a control system, which may in turn control the opening and closing of the MCV 218. It will thus be understood that the control signal u(t) may likewise be used to actuate the control units of other heave compensation systems, without departing from the scope of the disclosure.

In order to determine the control signal u(t), it is required to determine the amplitude, phase, frequency, and decay rate thereof. Because the ocean waves exhibit a relatively cyclic nature over a finite time period, embodiments disclosed herein utilize the vibration damping performance of past ocean wave cycles to determine the control signal u(t) for a current cycle.

Figure 5:
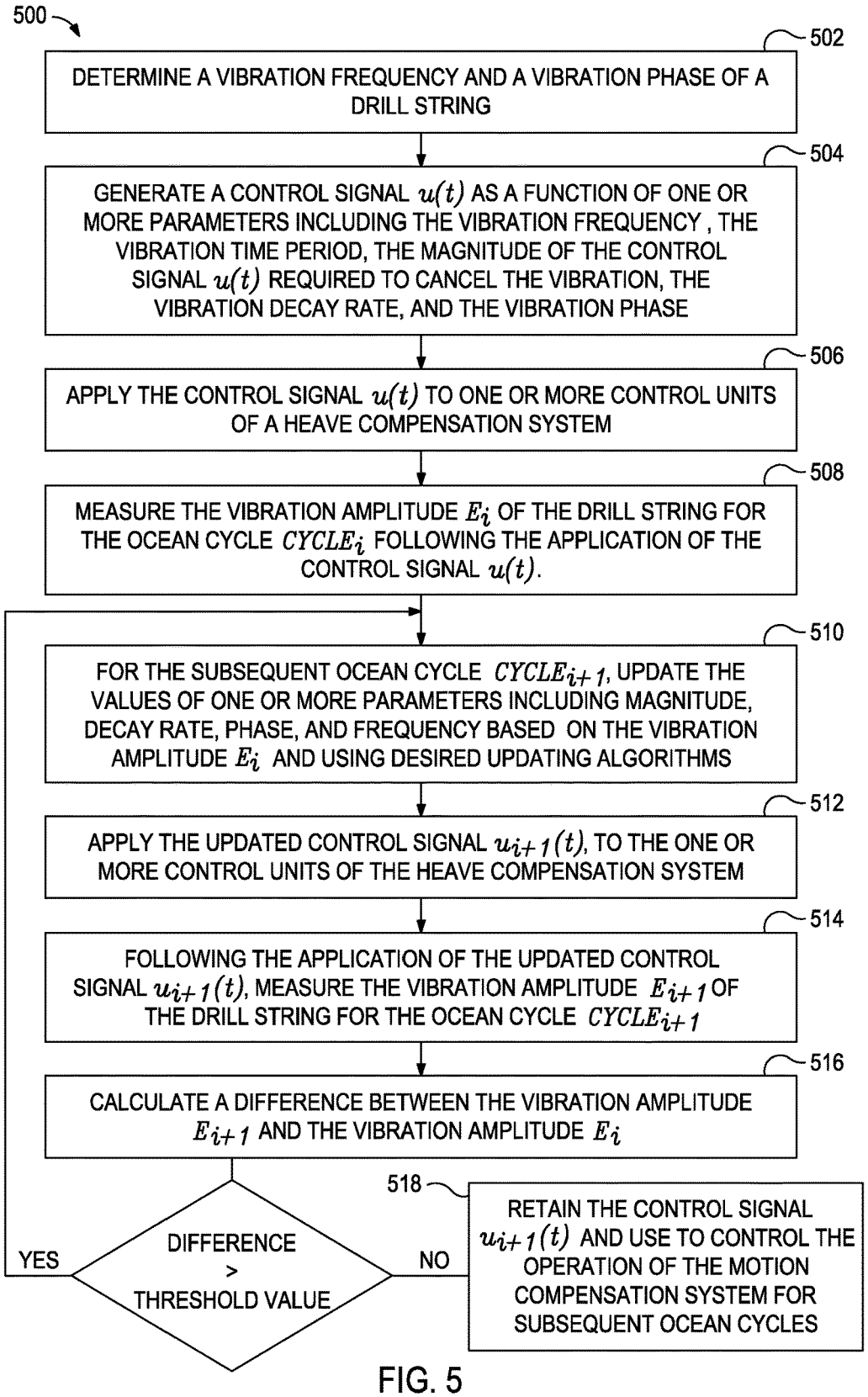
FIG. 5 is a flowchart of the exemplary vibration compensation method.

FIG. 5 illustrates a schematic flowchart of an exemplary vibration compensation method 500, according to one or more embodiments. During the first control cycle, no control signal u(t) is generated and a vibration frequency $\omega_{learnt}^{1}$ (e.g., corresponding to one period of the ocean wave, FIG. 3) of the drill string 120 or the floating vessel 102 (FIG. 1) and the vibration phase $\varphi_{learnt}^{1}$ are determined, as at 502. The control signal u(t) is then generated as a function of the vibration frequency $\omega_{learnt}^{1}$, the vibration time period t, the magnitude A of the control signal u(t) required to cancel the vibration, the vibration decay rate τ, and the vibration phase $\varphi_{learnt}^{1}$, as at 504.

The control signal u(t) may be represented as $$u(t)=f(t,\omega_{learnt}^{1},A,\tau,\varphi_{learnt}^{1}) \quad \text{Equation 3}$$

The magnitude A and the decay rate τ can be obtained from lookup tables. For example, the lookup tables may include magnitude A and decay rate τ values corresponding to different vibration amplitudes of ocean waves and which are required to produce a control signal u(t) for cancelling a corresponding vibration amplitude of the ocean wave. The different values of amplitude A and decay rate τ may be based on empirical data (e.g., a posteriori data) obtained from one or more previous implementations of the vibration compensation method.

As at 506, the control signal u(t) obtained from Equation 3 is then applied to one or more control units of a heave compensation system. For instance, the control signal u(t) may be used to actuate (open or close) the MCV 218 of the motion compensation system 200 in FIG. 2.

At 508, the vibration amplitude $E_i$ of the drill string 120 (or the floating vessel 102) is measured for the ocean cycle, referred to as $Cycle_i$, following the application of the control signal u(t). At 510, for the subsequent ocean cycle $Cycle_{i+1}$, the values of the parameters magnitude A, decay rate τ, phase φ, and frequency ω of the control signal u(t) may be updated based on the vibration amplitude $E_i$ and using the following algorithms (collectively referred to as Equations 4):

$$A^{i+1} = A^{i} - \frac{dE_i}{dA^i} \times E_i \times step_A^i$$

$$\tau^{i+1} = \tau^{i} - \frac{dE_i}{d\tau^i} \times E_i \times step_\tau^i$$

$$\omega^{i+1} = \omega^{i} - \frac{dE_i}{d\omega^i} \times E_i \times step_\omega^i$$

$$\varphi^{i+1} = \varphi^{i} - \frac{dE_i}{d\varphi^i} \times E_i \times step_\varphi^i$$

wherein each of $step_A^i$, $step_\tau^i$, $step_\omega^i$, and $step_\varphi^i$ represent a positive step value or step size of the respective parameters magnitude A, decay rate τ, phase φ, and frequency ω. For each cycle $Cycle_i$, the step values may be obtained from algorithms such as exact line search algorithm. Alternatively or additionally, parameters magnitude A, decay rate τ, phase φ, and frequency ω may be provided as inputs to a lookup table and the step values corresponding to the input parameters may be obtained.

However, it will be understood that the above algorithms for updating the values of the parameters are merely examples and that the parameter values can be updated using other algorithms or equations as well. For instance, the parameters can be updated using the following algorithms (collectively referred to as Equations 5):

$$A^{i+1}=A^{i}-\text{sign}(A^{i}-A^{i+1})\text{sign}(E_i-E_{i-1})\times E_i\times \text{step}_A^{\,i}$$

$$\tau^{i+1}=\tau^{i}-\text{sign}(\tau^{i}-\tau^{i+1})\text{sign}(E_i-E_{i-1})\times E_i\times \text{step}_\tau^{\,i}$$

$$\omega^{i+1}=\omega^{i}-\text{sign}(\omega^{i}-\omega^{i+1})\text{sign}(E_i-E_{i-1})\times E_i\times \text{step}_\omega^{\,i}$$

$$\varphi^{i+1}=\varphi^{i}-\text{sign}(\varphi^{i}-\varphi^{i+1})\text{sign}(E_i-E_{i-1})\times E_i\times \text{step}_\varphi^{\,i}$$

In other examples, optimization methods such as Newton's method and extreme seeking method can also be used for updating the parameters.

Based on the updated parameters, an updated control signal $u_{i+1}(t)$ is applied to the one or more control units of the heave compensation system, as at 512. For example, the updated control signal $u_{i+1}(t)$ may be applied to the MCV 218 of the motion compensation system 200 in FIG. 2 during the ocean cycle $Cycle_{i+1}$. The updated control signal $u_{i+1}(t)$ may be represented as $$u_{i+1}(t)=f(t,\omega^{i+1},A^{i+1},\tau^{i+1},\varphi^{i+1}) \quad \text{Equation 6}$$

Following the application of the updated control signal $u_{i+1}(t)$, the vibration amplitude $E_{i+1}$ of the drill string 120 (or the floating vessel 102) is measured for the ocean cycle $Cycle_{i+1}$, as at 514.

A difference between the vibration amplitude $E_{i+1}$ and the vibration amplitude $E_i$ of the previous cycle $Cycle_i$ is then calculated and compared with a pre-determined threshold value, as at 516. If the difference is less than the pre-determined threshold value, then the control signal $u_{i+1}(t)$ is retained (or maintained at the determined value) and is used as the control signal for the subsequent ocean cycles, as at 518. If the difference is greater than the pre-determined threshold value, then one or more parameters above are updated based on the vibration amplitude of the previous cycle $Cycle_{i+1}$, for instance, using the vibration amplitude cycle $E_{i+1}$, and an updated control signal $u_{i+2}(t)$ is generated, as at 510. The values of the parameters magnitude A, decay rate τ, phase φ, and frequency ω may be updated based on the algorithms above in any of Equations 4 and 5, or any other desired algorithms. The updated control signal $u_{i+2}(t)$ is then applied to the one or more control units of the motion compensation system for further vibration control.

It should be noted that the control signal u(t) may be a quantized signal that may vary over a range of discrete values each indicating an amount of control that is to be applied to the control units of the heave compensation systems. For instance, in the case of the motion compensation system 200 in FIG. 2, the value of control signal u(t) may indicate a flow rate of fluid passing through the MCV 218. Thus, if control signal u(t) has a value of 0.1, then the MCV 218 is opened (or closed) such that a flow rate of fluid through the MCV 218 is around 10% of the flow rate when the MCV 218 is completely open. Accordingly, it will be understood that the vibration compensation method, according to the embodiments disclosed above, generates a control signal u(t) having a relatively smaller step size compared to the step size of a control signal provided by existing PID controllers. The smaller step size results in a relatively gradual and steady vibration control, thereby resulting in more efficient wellbore operations.

Figure 6:
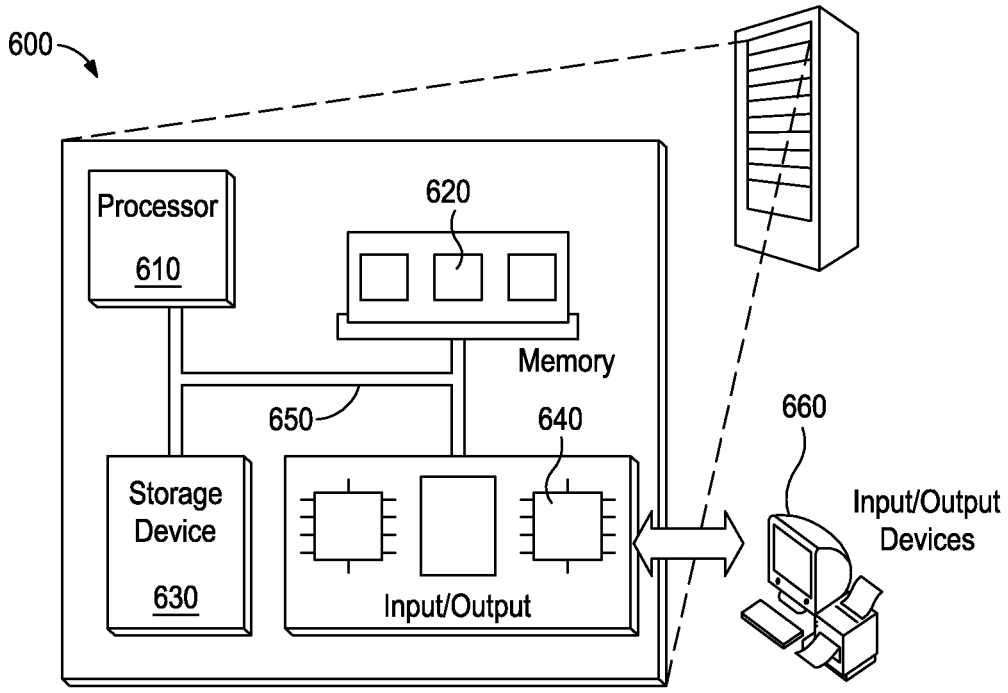
FIG. 6 shows an illustrative processing system for operating the motion compensation system of FIG. 2 based on the exemplary vibration compensation method and/or performing other tasks as described herein.

FIG. 6 shows an illustrative processing system 600 for operating the motion compensation system 200 using the exemplary vibration compensation method, storing the lookup tables including one or more of the magnitude A, decay rate $\tau$, phase $\varphi$, frequency $\omega$, and step values, and/or performing other tasks as described herein.

The system 600 may include a processor 610, a memory 620, a storage device 630, and an input/output device 640. Each of the components 610, 620, 630, and 640 may be interconnected, for example, using a system bus 650. The processor 610 may be processing instructions for execution within the system 600. In some embodiments, the processor 610 is a single-threaded processor, a multi-threaded processor, or another type of processor. The processor 610 may be capable of processing instructions stored in the memory 620 or on the storage device 630. The memory 620 and the storage device 630 can store information within the computer system 600.

The input/output device 640 may provide input/output operations for the system 600. In some embodiments, the input/output device 640 can include one or more network interface devices, e.g., an Ethernet card; a serial communication device, e.g., an RS-232 port; and/or a wireless interface device, e.g., an 802.11 card, a 3G wireless modem, or a 4G wireless modem. In some embodiments, the input/output device can include driver devices configured to receive input data and send output data to other input/output devices, e.g., keyboard, printer and display devices 660. In some embodiments, mobile computing devices, mobile communication devices, and other devices can be used.

In accordance with at least some embodiments, the disclosed methods and systems related to scanning and analyzing material may be implemented in digital electronic circuitry, or in computer software, firmware, or hardware, including the structures disclosed in this specification and their structural equivalents, or in combinations of one or more of them. Computer software may include, for example, one or more modules of instructions, encoded on computer-readable storage medium for execution by, or to control the operation of, a data processing apparatus. Examples of a computer-readable storage medium include non-transitory medium such as random access memory (RAM) devices, read only memory (ROM) devices, optical devices (e.g., CDs or DVDs), and disk drives.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing, and grid computing infrastructures.

A computer program (also known as a program, software, software application, script, or code) can be written in any form of programming language, including compiled or interpreted languages, declarative, or procedural languages. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be executed on one computer or on multiple computers that are located at one site or distributed across multiple sites and interconnected by a communication network.

Some of the processes and logic flows described in this specification may be performed by one or more programmable processors executing one or more computer programs to perform actions by operating on input data and generating output. The processes and logic flows may also be performed by, and apparatus may also be implemented as, special purpose logic circuitry, e.g., an FPGA (field programmable gate array) or an ASIC (application specific integrated circuit).

Processors suitable for the execution of a computer program include, by way of example, both general and special purpose microprocessors and processors of any kind of digital computer. Generally, a processor will receive instructions and data from a read-only memory or a random access memory or both. A computer includes a processor for performing actions in accordance with instructions and one or more memory devices for storing instructions and data. A computer may also include, or be operatively coupled to receive data from or transfer data to, or both, one or more mass storage devices for storing data, e.g., magnetic, magneto optical disks, or optical disks. However, a computer may not have such devices. Devices suitable for storing computer program instructions and data include all forms of non-volatile memory, media and memory devices, including by way of example semiconductor memory devices (e.g., EPROM, EEPROM, flash memory devices, and others), magnetic disks (e.g., internal hard disks, removable disks, and others), magneto optical disks, and CD-ROM and DVD-ROM disks. The processor and the memory can be supplemented by, or incorporated in, special purpose logic circuitry.

To provide for interaction with a user, operations may be implemented on a computer having a display device (e.g., a monitor, or another type of display device) for displaying information to the user and a keyboard and a pointing device (e.g., a mouse, a trackball, a tablet, a touch sensitive screen, or another type of pointing device) by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

A computer system may include a single computing device, or multiple computers that operate in proximity or generally remote from each other and typically interact through a communication network. Examples of communication networks include a local area network ("LAN") and a wide area network ("WAN"), an inter-network (e.g., the Internet), a network comprising a satellite link, and peer-to-peer networks (e.g., ad hoc peer-to-peer networks). A relationship of client and server may arise by virtue of computer programs running on the respective computers and having a client-server relationship to each other.

Embodiments disclosed herein include:

A. A vibration compensation method for a floating vessel that includes calculating a frequency and a phase of a vibration of the floating vessel, generating a control signal based on the vibration frequency and the vibration phase, operating a motion compensation system of the floating vessel during an $i^{th}$ control cycle using the control signal to mitigate the vibration of the floating vessel, calculating a first amplitude of the vibration based on the control signal, updating one or more parameters including a magnitude of the control signal, a decay rate of the vibration, the vibration phase, and the vibration frequency using the first vibration amplitude, updating the control signal based on the one or more updated parameters, and operating the motion compensation system based on the updated control signal during an $(i+1)^{th}$ control cycle.

B. A vibration compensation system for a floating vessel that includes a motion compensation system that mitigates vibration of the floating vessel, a computer system including a processor and a non-transitory computer readable medium, the computer system being communicatively coupled to the motion compensation system and the computer readable medium storing a computer readable program code that when executed by the processor causes the computer system to calculate a frequency and a phase of a vibration of the floating vessel, generate a control signal based on the vibration frequency and the vibration phase, operate a motion compensation system of the floating vessel during an $i^{th}$ control cycle using the control signal to mitigate the vibration of the floating vessel, calculate a first amplitude of the vibration based on the control signal, update one or more parameters including a magnitude of the control signal, a decay rate of the vibration, the vibration phase, and the vibration frequency using the first vibration amplitude, update the control signal based on the one or more updated parameters, and operate the motion compensation system based on the updated control signal during an $(i+1)^{th}$ control cycle.

Each of embodiments A and B may have one or more of the following additional elements in any combination: Element 1: further comprising calculating a second amplitude of the vibration of the floating vessel based on the updated control signal.

Element 2: further comprising retaining the updated control signal and operating the motion compensation system using the updated control signal when a difference between the first and second vibration amplitudes is less or equal to than a pre-determined value. Element 3: further comprising updating one or more of the parameters using the second vibration amplitude when a difference between the first and second vibration amplitudes is greater than a pre-determined value. Element 4: wherein the control signal and the updated control signal are quantized, and the method further comprises operating the motion compensation system using the quantized control signals. Element 5: further comprising generating the control signal based on a magnitude of the control signal required to cancel the vibration and the decay rate of the vibration, the magnitude and the decay rate representing empirical data. Element 6: further comprising generating the updated control signal such that a frequency or a phase of the updated control signal follows the vibration frequency and the vibration phase of the floating vessel.

Element 7: wherein executing the program code further causes the computer system to calculate a second amplitude of the vibration of the floating vessel based on the updated control signal. Element 8: wherein executing the program code further causes the computer system to retain the updated control signal and operate the motion compensation system using the updated control signal when a difference between the first and second vibration amplitudes is less or equal to than a pre-determined value. Element 9: wherein executing the program code further causes the computer system to update one or more of the parameters using the second vibration amplitude when a difference between the first and second vibration amplitudes is greater than a pre-determined value. Element 10: wherein the control signal and the updated control signal are quantized, and wherein the processor is further configured to operate the motion compensation system using the quantized control signals. Element 11: wherein executing the program code further causes the computer system to generate the control signal based on a magnitude of the control signal required to cancel the vibration and the decay rate of the vibration, the magnitude and the decay rate representing empirical data. Element 12: wherein executing the program code further causes the computer system to generate the updated control signal such that a frequency or a phase of the updated control signal follows the vibration frequency and the vibration phase of the floating vessel.

By way of non-limiting example, exemplary combinations applicable to A and B include: Element 1 with Element 2; Element 1 with Element 3; Element 7 with Element 8; and Element 7 with Element 9.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A vibration compensation method for a floating vessel, comprising:

calculating a frequency and a phase of a vibration of the floating vessel;

generating a control signal based on the vibration frequency and the vibration phase;

operating a motion compensation system of the floating vessel during an $i^{th}$ control cycle using the control signal to mitigate the vibration of the floating vessel;

calculating a first amplitude of the vibration based on the control signal;

updating one or more parameters including a magnitude of the control signal, a decay rate of the vibration, the vibration phase, and the vibration frequency using the first vibration amplitude;

updating the control signal based on the one or more updated parameters;

operating the motion compensation system based on the updated control signal during an $(i+1)^{th}$ control cycle;

calculating a second amplitude of the vibration of the floating vessel based on the updated control signal;

calculating a difference between the first vibration amplitude and the second vibration amplitude; and determining whether to update the one or more parameters of the control signal based on the difference.

2. The method of claim 1, further comprising retaining the updated control signal and operating the motion compensation system using the updated control signal when a difference between the first and second vibration amplitudes is less than or equal to a pre-determined value.

3. The method of claim 1, further comprising updating one or more of the parameters using the second vibration amplitude when a difference between the first and second vibration amplitudes is greater than a pre-determined value.

4. The method of claim 1, wherein the control signal and the updated control signal are quantized, and the method further comprises operating the motion compensation system using the quantized control signals.

5. The method of claim 1, further comprising generating the control signal based on a magnitude of the control signal required to cancel the vibration and the decay rate of the vibration, the magnitude and the decay rate representing empirical data.

6. The method of claim 1, further comprising generating the updated control signal such that a frequency or a phase of the updated control signal follows the vibration frequency and the vibration phase of the floating vessel.

7. A vibration compensation system for a floating vessel, comprising:

a motion compensation system that mitigates vibration of the floating vessel;

a computer system including a processor and a non-transitory computer readable medium, the computer system being communicatively coupled to the motion compensation system and the computer readable medium storing a computer readable program code that when executed by the processor causes the computer system to:

calculate a frequency and a phase of a vibration of the floating vessel;

generate a control signal based on the vibration frequency and the vibration phase;

operate the motion compensation system of the floating vessel during an $i^{th}$ control cycle using the control signal to mitigate the vibration of the floating vessel;

calculate a first amplitude of the vibration based on the control signal;

update one or more parameters including a magnitude of the control signal, a decay rate of the vibration, the vibration phase, and the vibration frequency using the first vibration amplitude;

update the control signal based on the one or more updated parameters;

operate the motion compensation system based on the updated control signal during an $(i+1)^{th}$ control cycle;

calculate a second amplitude of the vibration of the floating vessel based on the updated control signal;

calculate a difference between the first vibration amplitude and the second vibration amplitude; and determine whether to update the one or more parameters of the control signal based on the difference.

8. The system of claim 7, wherein executing the program code further causes the computer system to retain the updated control signal and operate the motion compensation system using the updated control signal when a difference between the first and second vibration amplitudes is less than or equal to a pre-determined value.

9. The system of claim 7, wherein executing the program code further causes the computer system to update one or more of the parameters using the second vibration amplitude when a difference between the first and second vibration amplitudes is greater than a pre-determined value.

10. The system of claim 7, wherein the control signal and the updated control signal are quantized, and wherein the processor is further configured to operate the motion compensation system using the quantized control signals.

11. The system of claim 7, wherein executing the program code further causes the computer system to generate the control signal based on a magnitude of the control signal required to cancel the vibration and the decay rate of the vibration, the magnitude and the decay rate representing empirical data.

12. The system of claim 7, wherein executing the program code further causes the computer system to generate the updated control signal such that a frequency or a phase of the updated control signal follows the vibration frequency and the vibration phase of the floating vessel.

* * * * *